US006244157B1

(12) United States Patent
Tseka

(10) Patent No.: US 6,244,157 B1
(45) Date of Patent: Jun. 12, 2001

(54) WIRE CARRIER PERFORATING GUN

(75) Inventor: Thomas C. Tseka, West Suffield, CT (US)

(73) Assignee: The Ensign-Bickford Company, Simsbury, CT (US)

( * ) Notice: Subject to any disclaimer, the term of this patent is extended or adjusted under 35 U.S.C. 154(b) by 0 days.

(21) Appl. No.: 09/366,143

(22) Filed: Aug. 3, 1999

(51) Int. Cl.[7] ..... E21B 29/00
(52) U.S. Cl. ..... 89/1.15; 166/55.2; 102/312
(58) Field of Search ..... 89/1.15; 166/55.2; 175/4.6; 102/312

(56) References Cited

U.S. PATENT DOCUMENTS

| | | | | |
|---|---|---|---|---|
| 2,818,808 | * | 1/1958 | Dill | 89/1.15 |
| 2,819,673 | * | 1/1958 | Cecil et al. | 89/1.15 |
| 2,889,774 | * | 6/1959 | Allen | 89/1.15 |
| 4,074,756 | | 2/1978 | Cooke, Jr. | 166/253 |
| 4,875,413 | | 10/1989 | Christopher et al. | 102/307 |
| 5,477,785 | | 12/1995 | Dieman, Jr. et al. | 102/313 |
| 5,509,356 | | 4/1996 | Renfro | 102/307 |
| 5,638,901 | | 6/1997 | Shirley et al. | 166/55.1 |
| 5,662,178 | | 9/1997 | Shirley et al. | 175/4.53 |
| 5,837,925 | * | 11/1998 | Nice | 102/310 |
| 6,098,707 | * | 8/2000 | Pastusek et al. | 166/55.1 |
| 6,167,957 | * | 1/2001 | Frazier | 89/1.15 |

* cited by examiner

*Primary Examiner*—J. Woodrow Eldred
(74) *Attorney, Agent, or Firm*—Libert & Associates; Victor E. Libert; Frederick A. Spaeth

(57) ABSTRACT

A perforating gun (10, 210, 310, 410) is provided for retaining a plurality of explosive charges (16, 16') in an angular phased array with the discharge ends (16*a,* 16*a'*) of each succeeding explosive charge (16, 16') disposed at a selected angular orientation relative to the other explosive charges (16, 16') as determined by the configuration of an undulating path defined by support wires (14, 14') or wire pairs (19*a,* 19*b*). The perforating gun (10, 210, 310, 410) comprises a plurality of support wires (14, 14') disposed about a common longitudinal axis (L—L) and extending in an undulating path so as to define a wire carrier or cage in which the explosive charges (16, 16') are retained by securing the discharge ends (16*a*), or the initiation ends (16*b*), or both, to support wires (14, 14). The undulating path of the support wires (14, 14') disposes the explosive charges (16, 16') in the angular orientation selected by selecting the pitch of the spiral-twisted support wires (14) of the retainer cage.

19 Claims, 7 Drawing Sheets

WIRE CARRIER PERFORATING GUN

BACKGROUND OF THE INVENTION

1. Field of the Invention

This invention relates to a perforating gun used for retaining a plurality of explosive charges in an angular phased array.

2. Related Art

Perforating guns are well known in the art and are used to form openings in subterranean wells, such as oil wells. Generally, a perforating gun is an assembly of explosive charges which, upon detonation, cause penetrations through the casing of a well bore into a geological formation allowing for the flow of, e.g., oil and gas, into the well bore, thence to the well head.

U.S. Pat. No. 4,875,413, which issued on Oct. 24, 1989 and is entitled "Apparatus For Perforating Wells", discloses a perforating gun apparatus comprising one or more shaped charges retained either by being screwed into threaded holes in a strip carrier as illustrated in FIGS. 11 and 12 or by being retained in a four-wire carrier. The latter is illustrated in FIGS. 9 and 10 and is described at col. 3, lines 51–68. The four-wire carrier is comprised of two pairs 42 and 44 of straight, parallel wires (46, 48 and 50, 52) which contain bent portions 54 and 56 to accommodate the extensions 20 (FIG. 10) and 30 (FIG. 9) of the shaped charges 10. See column 3, lines 59–66, and column 4, lines 9–19. The pairs 42 and 44 of wires include connectors 58 and 60, respectively, which hold the wires together. See column 3, lines 67–68.

U.S. Pat. No. 5,638,901, which issued on Jun. 17, 1997 and is entitled "Spiral Strip Perforating System", discloses a perforating gun apparatus comprising an elongated spiral strip carrier on which a plurality of shaped charges is threadably mounted. Related (confinuation-in-part) U.S. Pat. No. 5,662,178, which issued on Sep. 2, 1997 and is entitled "Wave Strip Perforating System", discloses a spiral strip carrier which is not helical or spiral, but is described as a wave or non-linear zigzag form as seen in plan view. See the Abstract, FIGS. 10 and 11 and col. 4, line 48 to col. 5, line 25 of this Patent.

SUMMARY OF THE INVENTION

In accordance with the present invention there is provided a perforating gun for retaining a plurality of explosive charges in an angularly phased, linear array. The perforating gun comprises a plurality of support wires extending in an undulating path about a common longitudinal axis to define a longitudinally extending retainer cage. A plurality of explosive charges has respective discharge ends and initiation ends, the initiation ends being dimensioned and configured to receive a detonation signal transmission member, e.g., a detonating cord. The plurality of explosive charges is retained in a linear array within the retainer cage with the discharge ends thereof disposed along the undulating path and facing outwardly of the retainer cage. In this way, the discharge end of each succeeding explosive charge is at a selected angular orientation relative to the other explosive charges, which angular orientation is determined by the configuration of the undulating path.

In one aspect of the present invention, the support wires are helically twisted whereby to define the undulating path as a helical path.

In another aspect of the present invention, the support wires are arranged in a wire pair in which the support wires thereof are connected to each other by a series of connector ties disposed at intervals along the length of the wire pair.

Another aspect of the present invention provides for the support wires to be arranged in one or more wire pairs in which the support wires of a wire pair are in side-by-side alignment with each other (either in abutting contact with, or spaced from, each other) in a series of longitudinal segments of the wire pair, with the longitudinal segments being longitudinally spaced from each other by a series of loops, e.g., a series of closed loops. The loops are formed by the respective support wires of the wire pair diverging from each other and then re-converging towards each other to define the loops.

Yet another aspect of the present invention provides for the perforating gun to have a first connector at one end of the retainer cage and a second connector at the longitudinally opposite end of the retainer cage. The first and second connectors may be dimensioned and configured to connect the retainer cage to one or both of (a) additional retainer cages and (b) other fixtures such as, for example, hoisting equipment or a conveyor sub.

Other aspects of the present invention are provided by the following features, alone or in combination: the perforating gun may comprise at least one wire pair defined by two of the support wires cooperating with each other to define the wire pair; the explosive charges of the perforating gun may have respective engagement members on at least one of their discharge and initiation ends, which engagement members are retained between the support wires of the wire pair; and the support wires of the wire pair may be connected to each other by connector ties at intervals along the length thereof, to provide at least one wire pair.

In one aspect of the invention, wherein the explosive charges have respective engagement members comprising protuberant noses on their discharge ends and the protuberant noses are retained between the support wires of the wire pair.

Still another aspect of the present invention provides for the retainer cage to comprise at least a first support wire engaged with respective discharge ends of the explosive charges and at least a second support wire engaged with the respective initiation ends of the explosive charges, and a plurality of crosspieces connecting the first and second support wires to reinforce the retainer cage. For example, the retainer cage may comprise (1) a first pair of the support wires cooperating to provide a first wire pair engaging the discharge ends of the explosive charges and (2) a second pair of the support wires cooperating to provide a second wire pair engaging the initiation ends of the explosive charges.

Yet another aspect of the invention provides for a plurality of crosspieces connecting at least one support wire of the first wire pair to at least one support wire of the second wire pair in order to reinforce the retainer cage.

In accordance with another aspect of the present invention, one or more of the explosive charges of the perforating gun may be replaced by non-explosive spacer bodies, for example, a plurality of the explosive charges may be replaced by non-explosive spacer bodies.

In a related aspect of the present invention, the explosive charges have thereon respective engagement members which are dimensioned and configured to be engaged by the support wires of the retainer cage, and one or more of the explosive charges are replaced by non-explosive spacer bodies having thereon spacer engagement members which simulate the dimensions of the engagement members of the explosive charges.

The spacer members may comprise, for example, discs and the spacer engagement members may comprise peripheral grooves in the discs.

DETAILED DESCRIPTION OF THE INVENTION AND PREFERRED EMBODIMENTS THEREOF

Figure 1A:
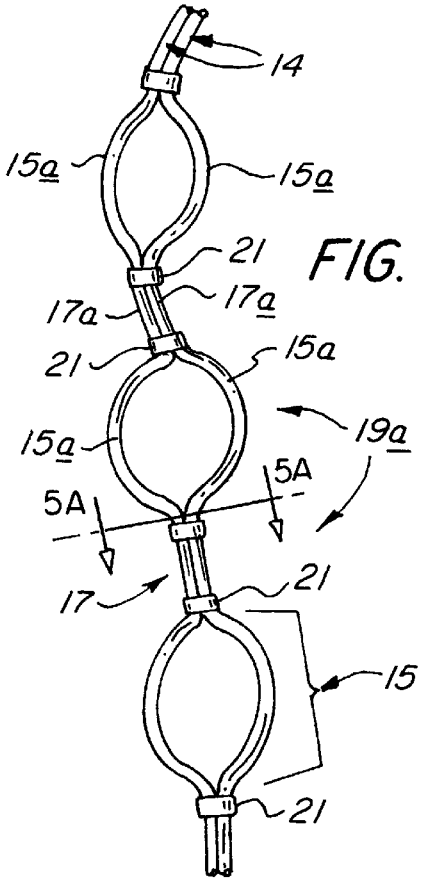
FIG. 1A is a perspective view of one pair only of the two pairs of support wires of the embodiment illustrated in FIG. 1, with the explosive charges, detonating cord and the second pair of support wires omitted for clarity of illustration and showing use of the retention clip of FIGS. 5 and 5A.
Figure 1:
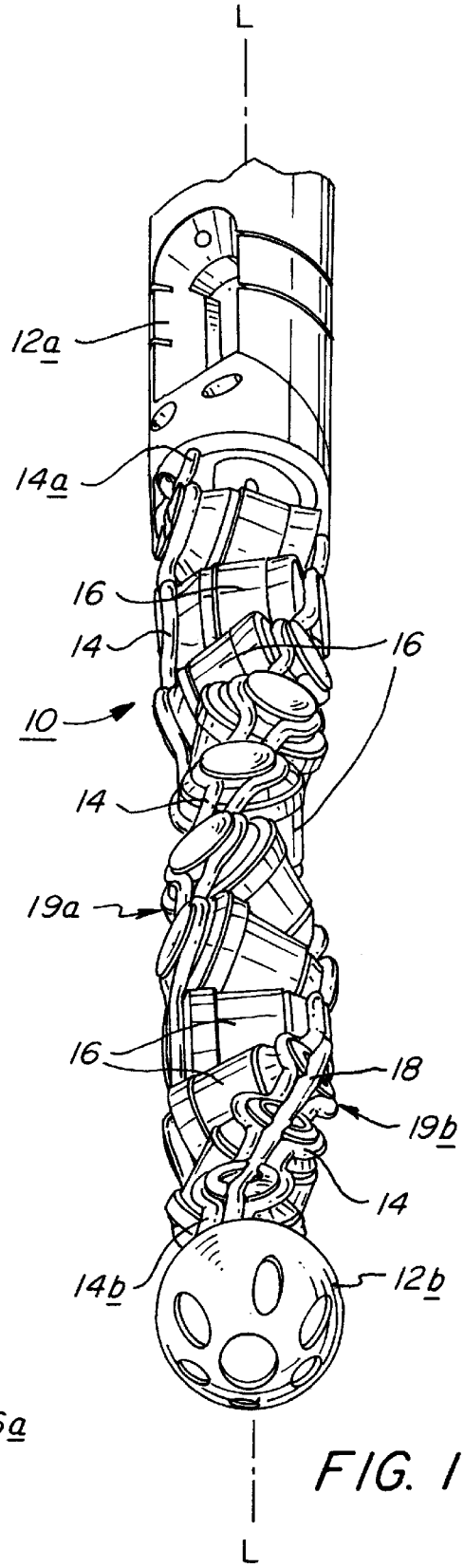
FIG. 1 is a perspective view of a first embodiment of a perforating gun of the present invention showing a plurality of explosive charges retained therein.

Referring now to FIG. 1 of the drawings, perforating gun 10 comprises a first connector 12*a* and a second connector, which in the illustrated embodiment is provided by a conveyor sub 12*b*. The first and second connectors are respectively located at opposite ends of a longitudinally extending four-wire carrier or cage (unnumbered) defined by a plurality of support wires 14, which are arranged into two wire pairs 19*a* (FIGS. 1 and 1A) and 19*b*. Each of support wires 14 has respective first and second ends 14*a*, 14*b* thereof which are respectively connected to the first connector 12*a* and the conveyor sub 12*b*. First connector 12*a* is dimensioned and configured to be connected to a lowering mechanism or to another perforating gun, and conveyor sub 12*b* is dimensioned and configured to provide a nose or lead fixture of perforating gun 10. Wire pairs 19*a*, 19*b* are each twisted in an undulating configuration which, in the illustrated embodiment, defines a helical path about the longitudinal axis L—L of perforating gun 10. FIG. 1A illustrates wire pair 19*a*, one of the two identical wire pairs 19*a*, 19*b* shown in FIG. 1. Referring to both FIGS. 1 and 1A, each support wire 14 has a series of half-loops 15*a* formed therein and separated by a series of spacer segments 17*a* so that when the two support wires 14 of a wire pair 19*a* or 19*b* are juxtaposed to each other, as best seen in FIG. 1A, the half-loops 15*a* cooperate to form a series of loops 15 and the paired spacer segments 17*a* cooperate to form a series of longitudinal segments 17. The paired support wires 14 of wire pair 19*a* are held together by a series of connector ties which, in the illustrated embodiment, are provided by retention clips 21, sometimes referred to in the art as "hog rings". Retention clips 21 are illustrated in FIGS. 5 and 5A. In FIG. 5, the retention clip is illustrated in the configuration it is in before being applied to secure a pair of support wires 14 together. In FIG. 5A, the retention clip 21 is shown after it is employed to band together two support wires 14 as shown in a cross-sectional view taken along line 5A—5A of FIG. 1A. In lieu of retention clips 21, the connector ties may be provided by band straps 23 (FIG. 5B), which may be utilized to hold the paired support wires 14 together in the same manner as retention clips 21. By holding together the support wires 14 of a wire pair 19*a*, 19*b*, the wire pairs, as described below, retain in place the linear, angularly phased array of the plurality of explosive charges 16.

Figure 7:
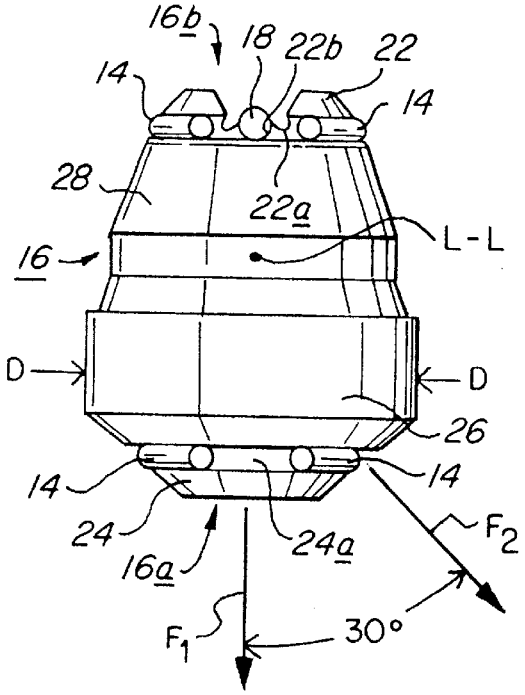
FIG. 7 is a schematic plan view of a typical explosive charge such as those illustrated in FIGS. 1, 2 and 3.

Perforating gun 10 thus includes a plurality of explosive charges 16, each of which has a discharge end 16*a* and an opposite, initiation end 16*b* which is connected to a detonation signal transmission member, such as a detonating cord 18, as more fully described below. Explosive charges 16 comprise shaped charges, and are disposed in a linear array along the longitudinal axis L—L with the discharge end 16*a* of each succeeding explosive charge 16 positioned at a selected angular orientation with respect to the other explosive charges 16. That is, the discharge end 16*a* of each explosive charge 16 is angularly oriented so that the perforation formed by the explosive force directed from the discharge end 16*a* of each explosive charge 16 is at a selected angular orientation to the perforations formed by the other explosive charges 16 as viewed in a plane taken perpendicularly to longitudinal axis L—L. For example, FIG. 7 schematically shows in plan view one of the explosive charges 16 of the array of explosive charges of FIG. 1 as viewed in a plane perpendicular to axis L—L of FIG. 1 so that support wires 14 and detonating cord 18 are viewed in cross section. In FIG. 7, vector arrow $F_1$ indicates the direction of travel of the focused explosive force which emanates from discharge end 16*a* of explosive charge 16 upon initiation thereof by detonating cord 18. The corresponding vector arrow $F_2$ shows the direction of travel of the focused explosive force emanating from the explosive charge immediately adjacent to that schematically illustrated in FIG. 7. Assuming that the immediately adjacent explosive charge is oriented at, for example, a thirty-degree angle from the illustrated explosive charge, the angle between vector arrows $F_1$ and $F_2$ will be thirty degrees. Additional explosive charges centered along longitudinal axis L—L in the linear array of explosive charges and phased at thirty degree angles will emit their focused explosive force along additional vector arrows (not shown) spaced at thirty-degree intervals from the vector arrow of the adjacent explosive charge. Obviously, any desired degree of angular orientation of selected explosive charges 16 relative to each other may be employed, from zero to 360 degrees. The angular orientation between explosive charges 16 may be selected in infinitesimally small increments simply by adjusting the pitch imparted to the twisted wire pairs 19*a,* 19*b*. That is, by twisting the wire pairs to a greater or lesser degree the angular orientation between explosive charges may be varied. The longitudinal distance between adjacent turns of the wire pairs is sometimes herein referred to as the "pitch" of the twisted wire pairs, by analogy to the pitch of the threads of a screw. (The same applies to the individual support wires of the embodiment of FIGS. 4–4C, described below.) At zero degrees angular orientation the discharge ends 16*a* of the selected charges will face in the same direction and at 180 degrees the discharge ends 16*a* will face in diametrically opposite directions. Relative angular orientations of 180 to 360 degrees will, of course, provide a mirror image of the relative angular orientations from zero to 180 degrees, with the zero and 360 degree orientations being identical to each other. The focused explosive forces emanating from shaped charges, such as explosive charges 16, as is well-known to those skilled in the art, are sufficiently powerful to penetrate the casing of a well and enter into the surrounding geological formation to provide channels or openings from the surrounding geological formations into the well and through which oil, gas or other fluids enter the well. The channels opened along adjacent vector lines will be at different elevations, inasmuch as the explosive charges 16 of FIG. 1 are in a stacked, linear array disposed along longitudinal axis L—L.

Any suitable explosive charge, e.g., any suitable shaped charge, sometimes referred to in the art as a "perforator", may be utilized in accordance with the teachings of the present invention. Thus, the explosive charges 16 illustrated in FIGS. 1, 2 and 3 may be similar to or identical with those illustrated in FIGS. 4–4B.

Referring now to FIGS. 1 and 7, each of the plurality of explosive charges 16 has a discharge end 16*a* disposed at one end of a cap 26 and an initiation end 16*b* disposed at an opposite end of explosive charge 16 at the end of a body 28. At discharge end 16*a,* an engagement member is provided by a protuberant nose 24 formed on cap 26 (FIG. 7). Nose 24 has a groove 24*a* formed at the base thereof, which groove is dimensioned and configured to receive therein on opposite sides thereof a respective one of a pair of the support wires 14 of wire pair 19*a*. At the opposite, initiation end 16*b* of explosive charge 16 an engagement member is provided by an extension flange 22 which has formed at the base thereof a groove 22*a* similar to groove 24*a* of nose 24. Groove 22*a* of extension flange 22 is dimensioned and configured to receive therein respective ones of the support wires 14 of wire pair 19*b*.

Extension flange 22 also has cut into it a slot 22*b* which extends diametrically across extension flange 22 and receives therein detonating cord 18. A detonation signal transmission member is provided in all the illustrated embodiments by the detonating cord 18, which is retained within slot 22*b* by any suitable means (not shown in FIG. 7) which may include snap clips such as those illustrated in FIGS. 6 and 6A and discussed below.

In the perforating gun 10 of FIG. 1, the two wire pairs 19*a,* 19*b* comprised of support wires 14 respectively engage, by their loops 15 (FIG. 1A), the engagement member provided by the grooves 22*a* of extension flanges 22 and the grooves 24*a* of noses 24. There is thereby provided a four-wire carrier for the array of explosive charges 16. With this construction, it is seen that explosive charge 16 is securely received and retained within the cage provided by the two wire pairs 19*a,* 19*b* which are comprised of support wires 14. The two wire pairs 19*a,* 19*b* are each twisted into a spiral configuration, wire pair 19*a* being used to engage respective discharge ends 16*a* of explosive charges 16 and wire pair 19*b* being used to engage respective initiation ends 16*b* of the same explosive charges 16.

The resultant four-wire retainer cage (unnumbered) is sufficiently rigid so that perforating gun 10 may be lowered through a well pipe and, facilitated by conveyor sub 12*b*, force its way past any obstructions or blockages in the well pipe. The four wire retainer cage also provides a degree of resiliency and flexibility which facilitates the passage of perforating gun 10 through a well pipe, allowing it to accommodate to a certain degree, by being compressed and deflecting, obstacles which it may encounter. This facilitates obtaining a desirably high rate of travel of perforating gun 10 through a well pipe, for example, about 500 feet per minute (about 152 meters per minute). More or fewer than four support wires may be used for the retainer cage. For example, FIGS. 2 and 3, described below, illustrate two-wire retainer cages and these provide a perforating gun, the rigidity and strength of which is sufficient in many circumstances to push past obstacles in the well pipe and travel through the pipe at a desirably high rate of speed.

Generally, the amount of metal contained in the support wires 14 is considerably less than the amount of metal required for spiral strip guns, thereby reducing the weight and cost of the perforating gun. The support wires 14 are desirably made thick enough to resist being severed by detonation of the explosive charges 16, thereby avoiding the depositing of debris in the bottom of the well. Support wires 14 will normally be made of steel.

Figure 2:
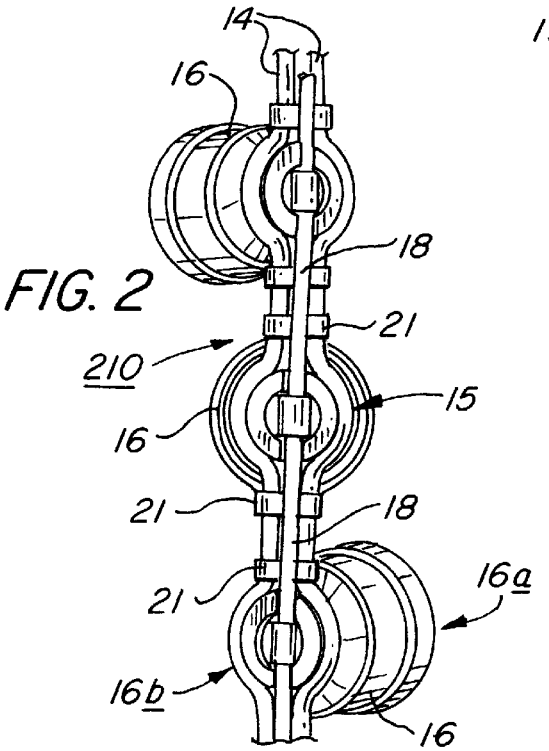
FIG. 2 is a perspective view of a segment of a second embodiment of a perforating gun of the present invention.

Another embodiment of the present invention in which the explosive charges 16 are supported only at the initiation ends 16*b* thereof is illustrated in FIG. 2, wherein perforating gun 210 is shown as being comprised of paired support wires 14 which, in the longitudinal segments 17 thereof, are in side-by-side congruence with each other, i.e., they are substantially parallel in the illustrated embodiment, but are not in abutting contact with each other. In this embodiment, the loops 15 are not fully closed. It is to be noted that in all embodiments of the invention, the support wires are "twisted", this is, they are dimensioned and configured to follow an undulating, e.g., a helical, or spiral, or the like, path, whereby to position and retain the explosive charges in selected different angular alignments relative to each other.

Figure 3:
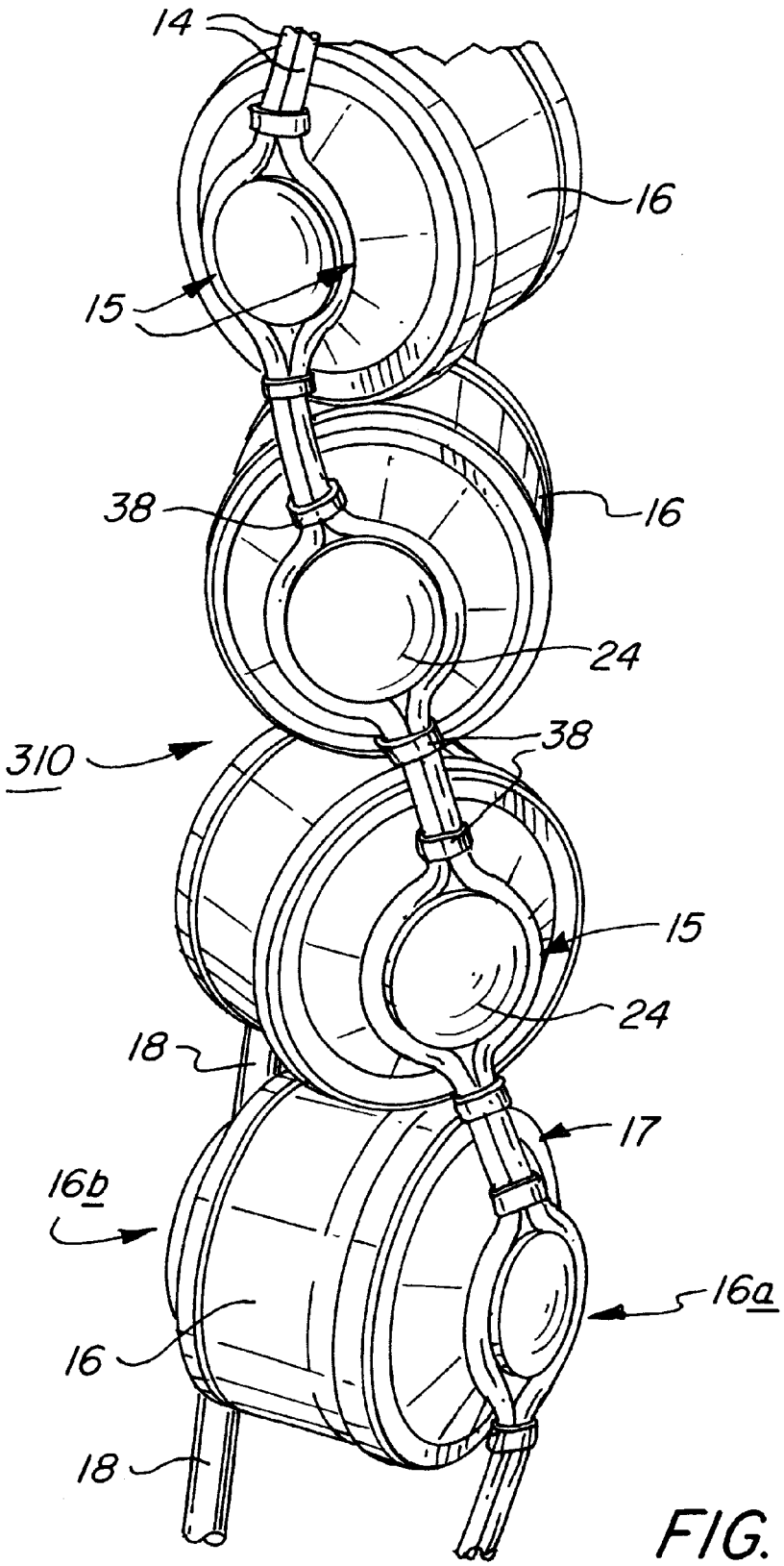
FIG. 3 is a perspective view of a segment of a third embodiment of the perforating gun of the present invention.

As illustrated in FIG. 3, a perforating gun 310 comprises a single pair of support wires 14 formed to define loops 15 and utilized to support a phased array of explosive charges 16 only at the discharge ends 16*a* thereof. FIG. 3 thus illustrates another embodiment of the present invention in which a pair of support wires 14 are secured to each other by a series of band straps 38 and are formed to provide a series of closed loops 15 alternating with a series of longitudinal segments 17 in a construction similar to that illustrated in FIG. 1A. The closed loops 15 are formed by a series of spaced-apart bent sections of paired support wires 14. In all cases, other or additional means, such as spot welding, may be used to join support wires 14 together, but are not usually required. The interior of the series of closed loops 15 may optionally be threaded, or a threaded or other fixture (not shown) may be inserted within each of the closed loops so as to engage an explosive charge 16 having a threaded nose end. Preferably, closed loops 15 are simply sized to securely engage the nose 24 of each explosive charge 16, which nose may be provided with a suitable groove, such as groove 24*a* shown in FIG. 7. Nose 24 need not be threaded unless it is desired to use therewith a threaded fixture such as fastener plate 36, described below.

Figure 4:
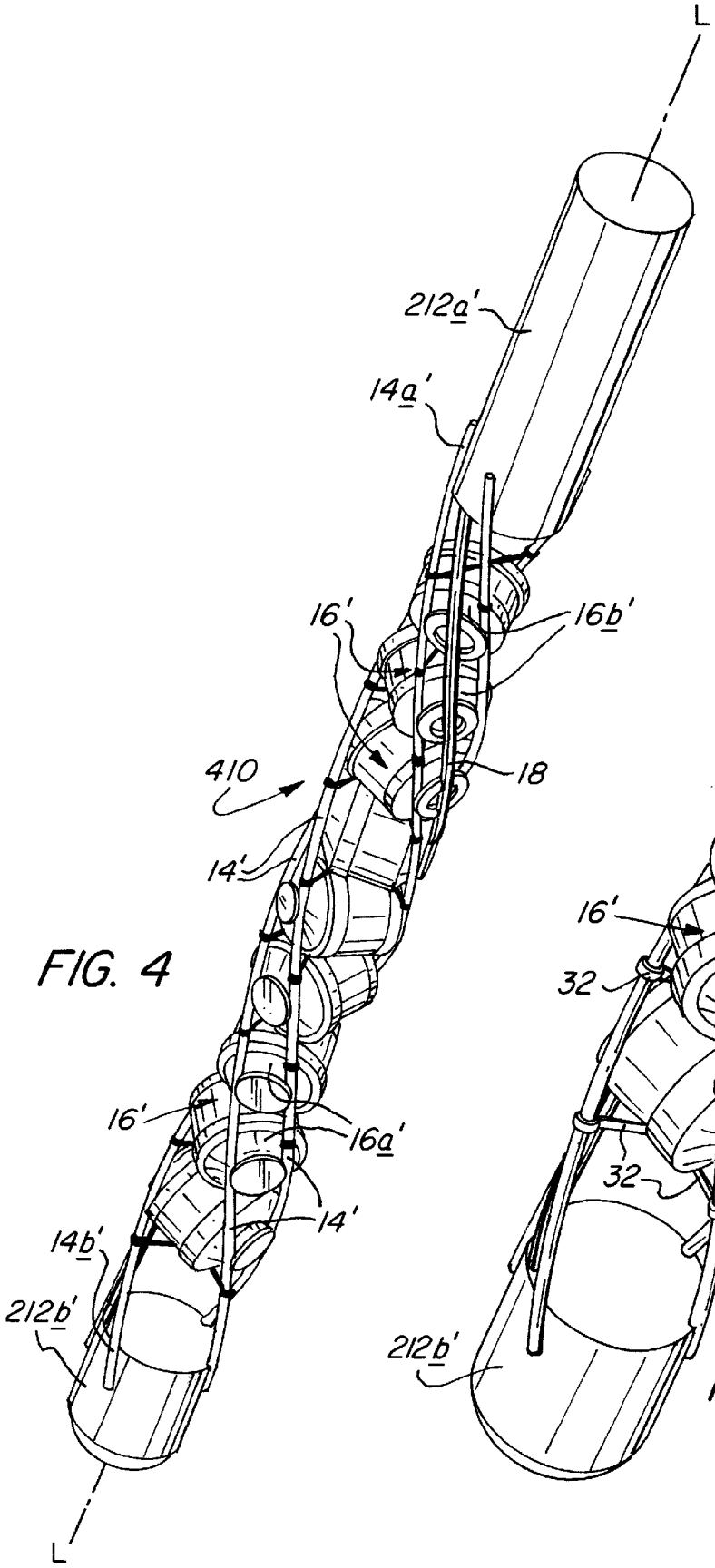
FIG. 4 is a perspective view of a fourth embodiment of the perforating gun of the present invention.
Figure 4A:
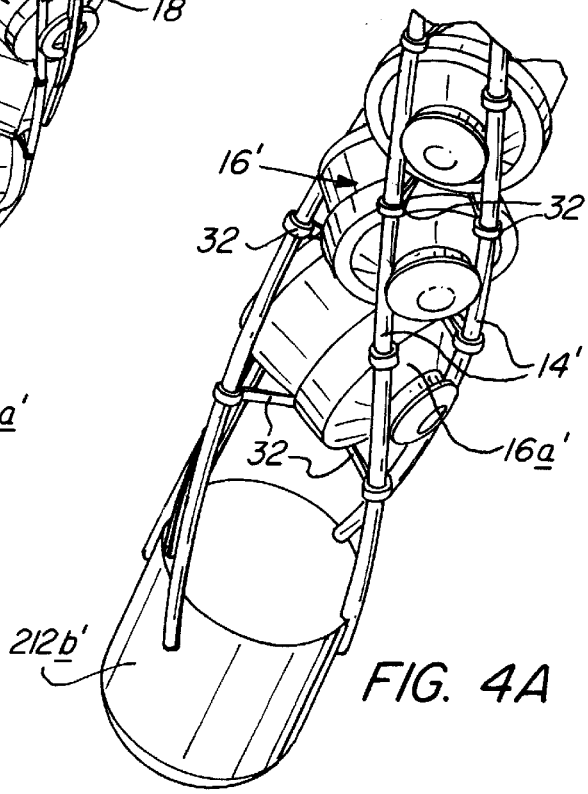
FIG. 4A is a view, enlarged relative to FIG. 4, of the lowermost (as viewed in FIG. 4) segment of the perforating gun of FIG. 4.

Referring now to FIGS. 4 and 4A, there is shown another embodiment of a perforating gun in accordance with the present invention. (Parts of the embodiment of FIGS. 4–4C which are identical or similar in structure and finction to corresponding parts of the embodiment of FIG. 1 are identically numbered, except for the addition of a prime indicator. Accordingly, the description of some of these parts is not repeated.) In this embodiment, perforating gun 410 comprises a first connector 212*a* ' and a conveyor sub 212*b* ' and two pairs of support wires 14' which are wound in a continuous spiral or helix between first connector 212*a* and conveyor sub 212*b*. Support wires 14' have respective opposite ends 14*a*', 14*b* ' which are connected, respectively, to first connector 212*a* ' and conveyor sub 212*b*'. It will be noted that, unlike the embodiments of FIGS. 1–3, the support wires 14' of the embodiment of FIG. 4 are not formed into loops and longitudinal segments, but are simply smoothly curved into the spiral or helical configuration.

Figure 4B:
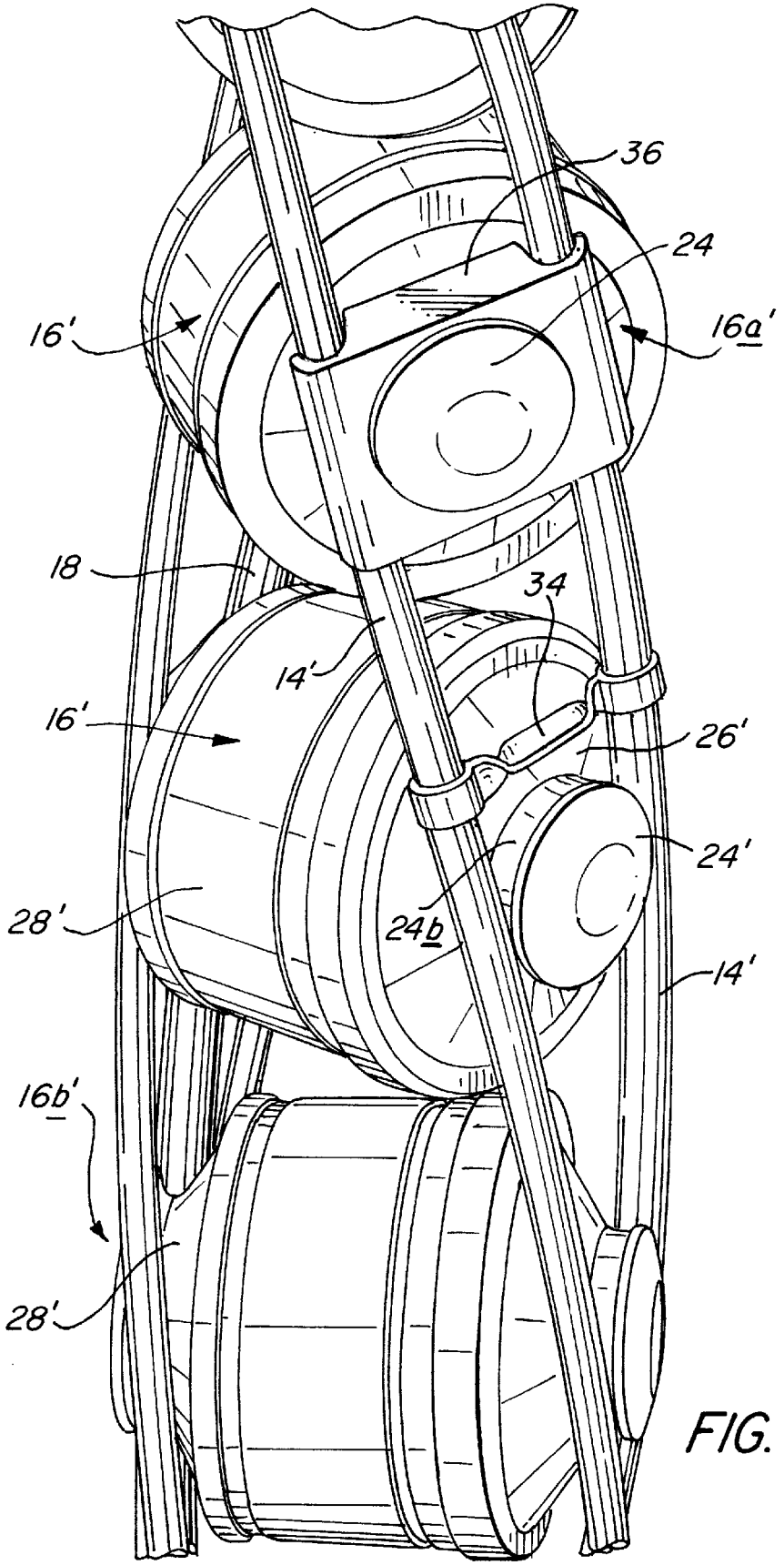
FIG. 4B is an enlarged, perspective view of a segment of the embodiment of FIG. 4, showing the discharge ends of the explosive charges and illustrating use of the turnbuckle strip and fastener plate of, respectively, FIGS. 5C and 5D.
Figure 4C:
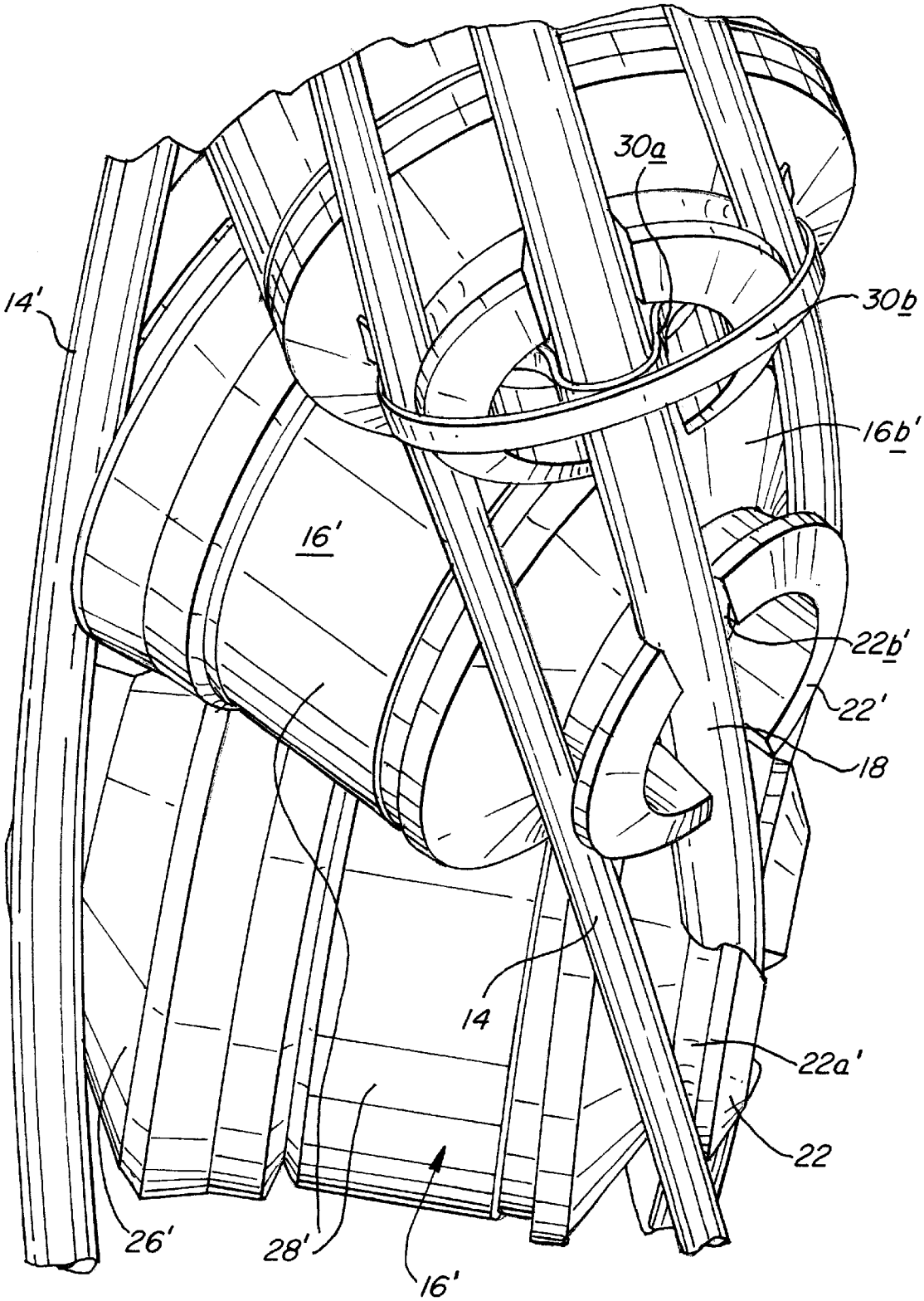
FIG. 4C is an enlarged perspective view of another segment of the embodiment of FIG. 4 showing the initiation ends of the explosive charges.
Figure 6:
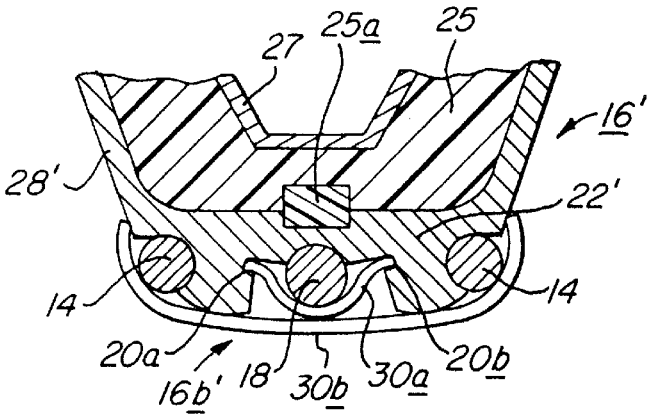
FIG. 6 is a partial cross-sectional plan view of the initiation end of a typical one of the explosive charges illustrated in FIGS. 4A and 4B and showing the use of a snap clip and a retainer clip which are usable as components of the embodiments of FIGS. 1 through 4.
Figure 6A:
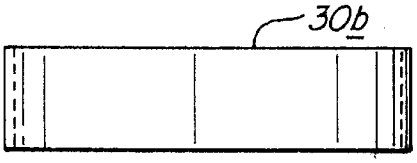
FIG. 6A is an elevation view of the retainer clip illustrated in FIG. 6.
Figure 7A:
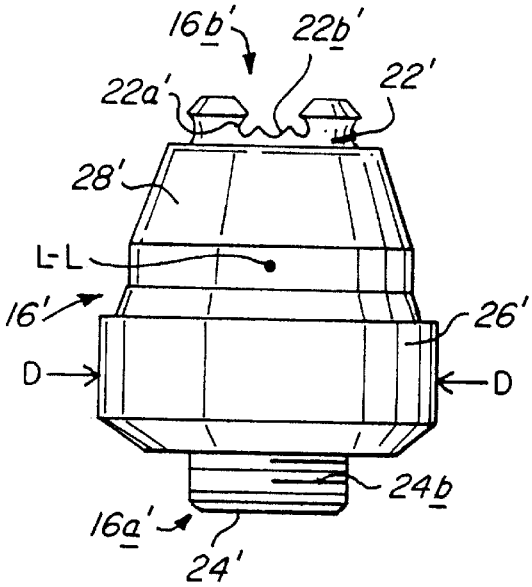
FIG. 7A is a view corresponding to FIG. 7 but of a different embodiment of a typical explosive charge such as those illustrated in FIGS. 4B and 4C.

As shown in FIGS. 4B and 4C and in FIG. 7A, each of the plurality of explosive charges 16' used in the embodiment of FIG. 4 has a discharge end 16*a* ' and an initiation end 16*b*' disposed at opposite ends of a body 28'. At discharge end 16*a*', a threaded nose 24' (FIG. 7A) having thereon threads 24*b* protrudes from a cap 26' which threadably engages one end of the body 28' of explosive charge 16'. A flange 22' protrudes from the opposite, initiation end 16*b*' of explosive charge 16' (FIGS. 4C and 7A). Flange 22' has formed therein a radial slot 22*b* ' within which a detonating cord 18 (FIGS. 1 and 4C) is received. Except for nose 24', the construction of explosive charge 16' is substantially identical to that of explosive charge 16 of FIG. 7 and details thereof need not be repeated except to note that, as in the FIG. 7 embodiment, body 28' (and thereby flange 22') is rotatable relative to discharge nose 24' and cap 26'. This enables rotation of extension flange 22' relative to cap 26' to thereby permit alignment of slot 22*b* ' to more easily receive therein detonating cord 18. Once received within slot 22*b* ' of explosive charge 16', the detonating cord 18 may be held in place by a first snap clip 30*a* (FIG. 6). As shown in the cross-sectional view of FIG. 6, the opposite ends of first snap clip 30*a* fit into recesses 20*a*, 20*b* suitably formed in slot 22*b* at the initiation end 16*b* ' of explosive charge 16'. A second snap clip 30*b*, shown in plan view in FIG. 6 and in elevation view in FIG. 6A, is clipped about extension flange 22' and serves to help retain both detonating cord 18 and support wires 14 in place. Second snap clip 30*b* is dimensioned and configured so that it has to be spread to engage extension flange 22' as illustrated in FIG. 6, whereby the spring action imposed by the tendency of second snap clip 30*b* to return to its normal, more tightly closed position exerts a gripping force about flange extension 22'. Alternatively, or in addition, second snap clip 30*b* may be suitably secured to initiation end 16*b* ' of explosive charge 16' by any suitable fastener. Detonating cord 18 is threaded through radial slot 22*b* ' of the initiation end 16*b* ' of each explosive charge in the same manner as described above. Detonating cord 18 is thus, in the known manner, held in explosive signal communication with the shaped explosive 25 (FIG. 6) contained within each of explosive charges 16' (and 16) whereby initiation of detonating cord 18 will initiate in turn each of explosive charges 16'.

The diameter D of explosive charge 16 or 16' is shown in both FIGS. 7 and 7A. For an explosive charge having a diameter D of, for example, 1½ inches (about 3.81 cm), the explosive charges 16 or 16' maybe spaced apart from each other in linear array a distance of about 2 inches (about 5.08 cm) centerline to centerline, which will leave about one-half inch (about 1.27 cm) spacing between adjacent explosive charges 16 or 16'.

Figure 5C:
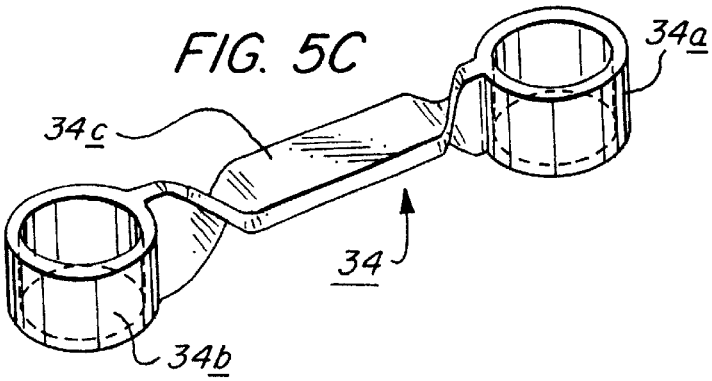
FIG. 5C is a perspective view of a turnbuckle strap usable as a component of the embodiment of FIG. 4.
Figure 5:
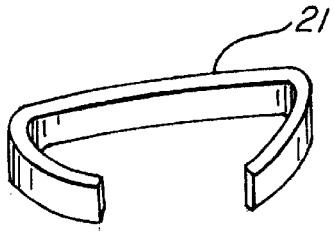
FIG. 5 is a perspective view of a retention clip usable as a component of the embodiments of any of FIGS. 1 through 3 and shown in its pre-application configuration.
Figure 5A:
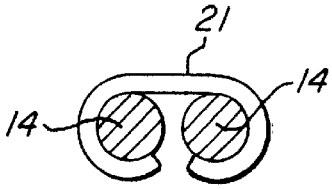
FIG. 5A is a section view taken along line 5A—5A of FIG. 1A and showing the retention clip of FIG. 5 in its post-application configuration.

FIG. 5C illustrates a typical tightening strap 34 having end loops 34*a* and 34*b* at the opposite ends of a turnbuckle strap 34*c*. Loops 34*a* and 34*b* are secured to the paired support wires 14 between which noses 24' are received (as best seen in FIG. 4) and turnbuckle strap 34*c* may be turned to tighten the paired wires 14 about noses 24 to more securely retain noses 24 within, and further increase the structural rigidity of, the cage provided by support wires 14. For the same purposes, tightening straps 34 may also be used to connect the adjacent pairs of wires 14 within which extension flanges 22 (FIG. 4C) are secured. FIG. 4C shows the initiation ends 16*b* ' of the plurality of explosive charges 16' engaged by a pair of adjacent support wires 14 which are respectively received within groove 22*a* ' of extension flange 22'.

The angular orientation between adjacent ones of the explosive charges 16 or 16', as noted above, is determined by the degree of "twist", i.e., the pitch of the undulating path defined by the support wires 14' (FIGS. 4–4C) or the wire pairs, 19*a*, 19*b* (FIGS. 1–3). Therefore, the angular orientation between adjacent explosive charges may be set in infinitesimally small increments simply by adjusting the degree of twist of the support wires 14. This is a great advantage over constructions in which mounting fixtures or spiral strips have to be custom made for each different angular orientation desired between adjacent explosive charges.

Connector ties may comprise any one or more of retainer clip 21, a band strap 23, or, as described below, turnbuckle strap 34 and fastener plate 36. A given perforating gun may utilize only one such type of connector tie, for example, the retainer clips or band straps, or it may use two or more different types of such connector ties in various combinations.

Figure 5D:
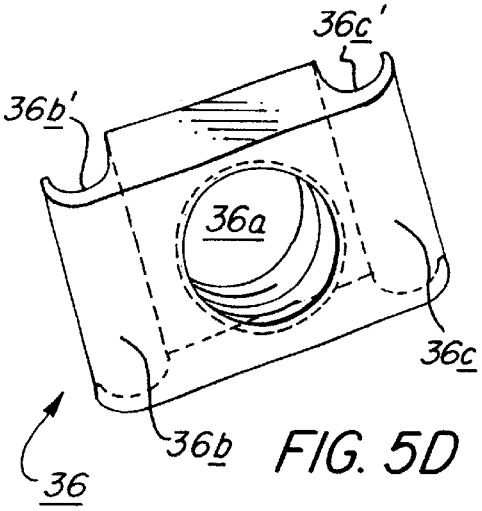
FIG. 5D is a perspective view of a fastener plate usable as a component of the embodiment of FIG. 4.
Figure 5B:
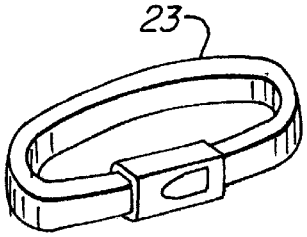
FIG. 5B is a perspective view of a band strap usable, in lieu of the retention clip of FIGS. 5 and 5A, as a component of the embodiment of FIG. 4.

FIG. 5D shows a typical fastener plate 36, which has a threaded aperture 36*a* formed therein to threadably receive therein the threaded portion 24*b* of nose 24' of an explosive charge 16'. Alternatively, fastener plate 36 may be affixed to nose 24 by any other suitable means, such as spot welding, in which case nose 24 need not be threaded. Fastener plate 36 also has a pair of flanges 36*b*, 36*c*, which define semicircular wire-receiving channels 36*b*', 36*c*' which serve to secure paired support wires 14 in place, as seen in FIG. 4B. FIG. 4B illustrates a segment of the linear array of explosive charges 16' disposed along the longitudinal axis L—L in angular phased array, each of the explosive charges 16' being retained in linear, phased angular array within the retainer cage (unnumbered) provided by support wires 14'. Fastener plates 36 are optional, because a pair of support wires 14' may be clamped onto nose 24' by means of retainer clips 21 (FIG. 5) or band straps 23 (FIG. 5B) holding wires 14' together. Because support wires 14' are not formed with half-loops and spacer segments (such as 15*a*, 17*a* of FIG. 1A) they remain separated by the diameter of nose 24' but nonetheless may be clamped together, e.g., by retainer clips gripping the paired support wires 14' on diametrically opposite sides of nose 24' to clamp the support wires 14' onto nose 24'. More positive retention of support wires 14 is, however, attained by the use of fastener plates 36, or the utilization of explosive charges having a groove at the base of the nose (such as groove 24*a* of FIG. 7). In any case, as shown in FIG. 4B, a pair of support wires 14' is retained by the flanges 36*b*, 36*c* of fastener plate 36 which is fastened to noses 24 of some or each of the explosive charges 16'. One pair of the spiral or helical twisted support wires 14' thus engages and retains the discharge end 16*a* ' of each explosive charge 16' and the other pair of twisted support wires 14' engages and retains the initiation end 16*b* ' of each explosive charge 16'. Crosspieces 32 (best seen in FIG. 4A) connect diagonally opposite pairs of support wires 14' and are provided to increase the structural integrity of the "retainer cage" provided by the support wires 14' of the four-wire carrier.

The angular orientation of each succeeding explosive charge 16' is determined by the configuration of the spiral or helical paths subtended by the pair of adjacent support wires 14' between which the noses 24' of explosive charges 16' are received, and the pair of adjacent support wires 14' between which flanges 22' are received.

The perforating guns 10 (of FIG. 1) and 410 (of FIG. 4) provide four-wire carriers, whereas the perforating guns 210 and 310 (of FIGS. 2 and 3) provide two-wire carriers. In all cases, the fact that the paired support wires 14 or 14' are twisted to subtend an undulating, e.g., helical, path about the longitudinal axis L—L (FIGS. 1 and 4) disposes the shaped charges 16 and 16' in an angular phased array. The pitch of the undulating path determines the angular spacing between adjacent explosive charges 16, 16'. The explosive charges 16, 16' are thereby disposed such that each succeeding explosive charge 16, 16' is positioned at a selected angular orientation with respect to the other explosive charges 16, 16', as illustrated in FIG. 7, by virtue of the undulating path followed by the support wires. In all cases, a plurality of explosive charges 16, 16' is suitably interconnected by a detonating cord 18 as described above. The explosive charges 16 illustrated in FIGS. 1, 2 and 3 may be different from or similar or identical to the explosive charges 16' illustrated in connection with the embodiment of FIGS. 4 and 4A.

Initiation of the plurality of explosive charges 16 or 16' is accomplished in the known manner by way of an initiation signal transmitted along the detonating cord 18. FIG. 6 shows a partial view of the interior construction typical of an explosive charge or perforator, such as explosive charges 16 and 16'. Thus, explosive charge 16' contains within its body 28' a shaped explosive 25, only the apex portion of which is visible in the partial view of FIG. 6, and the usual liner 27. A booster charge 25*a* is positioned in the known manner between detonating cord 18 and the apex of shaped explosive 25 so that booster charge 25*a* will readily be initiated by detonating cord 18 and will in turn initiate shaped explosive 25. The subsequent sequential detonation of each succeeding explosive charge 16 of the plurality of explosive charges 16 at a selected angular orientation is thereby effective in producing an angular phased array of explosive blasts emanating radially outwardly from the longitudinal axis L—L.

The retainer cage provided by support wires 14 and 14' of the various illustrated embodiments is strong enough to retain its structural integrity while being lowered into place in the well and to survive intact the detonation of explosive charges 16 to enable withdrawal of the cage from the well after detonation of the explosive charges 16. This requires that the individual support wires, usually made of steel, be thick enough and strong enough to withstand the detonation of the explosive charges. Because the cage structure remains intact, the deposition of debris in the well is avoided or minimized. The spring-like action provided by the support wires 14 or 14' takes up shock loads imposed on the perforating gun 10, 210, 310 or 410 by the conveyor sub or other components of the perforating gun striking obstacles in the well pipe.

Another advantage of the retainer cage provided by the support wires 14 or 14' is that the retainer cage does not protrude beyond the cross-sectional profile established by the explosive charges 16 or 16'. Therefore, the diameter of the perforating gun is not increased by the retainer cage provided by the support wires 14 or 14'. Stated otherwise, the support wires 14 or 14' are maintained inboard of the cross-sectional profile of the perforator gun 10 (or 210 or 310 or 410) which is determined by the profile of the explosive charges 16 or 16'.

Figure 8:
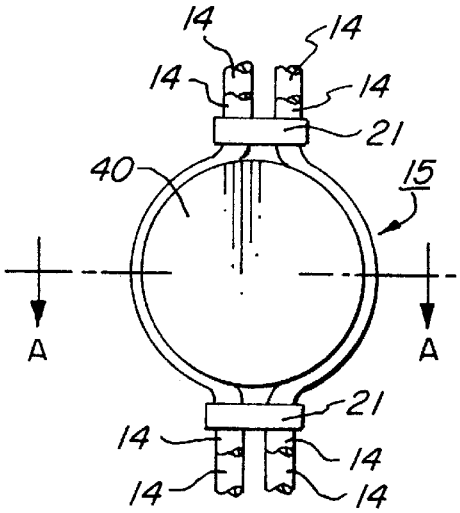
FIG. 8 is an elevation view of a spacer body retained in a segment of a perforating gun in accordance with an embodiment of the present invention.
Figure 8A:
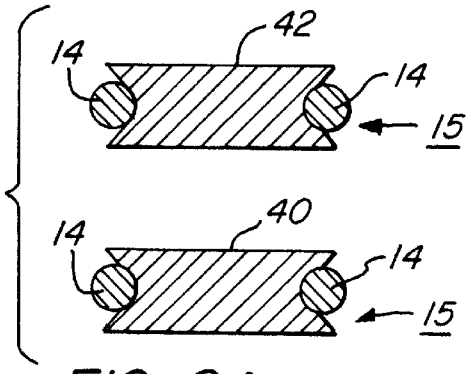
FIG. 8A is a cross-sectional view taken along line A—A of FIG. 8.

It is sometimes desired to replace one or more of the explosive charges in the perforating gun. For example, in some cases it is desired to use a given retainer cage comprised of pre-formed support wires, but to omit every third or every other explosive charge. In such case, in order to maintain the structural integrity, uniformity and rigidity of the retainer cage provided by the undulating support wires 14, it is desirable to place non-explosive spacer bodies in the retaining cage in place of the omitted explosive charges. The non-explosive spacer bodies will be engaged by the support wires in the same manner as the support wires engage the explosive charges. FIG. 8 shows a segment of a perforating gun of the present invention in which a pair of support wires 14 are held together as a wire pair by retention clips 21. Support wires 14 are, as described above, in this embodiment formed to provide a series of loops 15, only one of which is visible in FIG. 8, within which an explosive charge may be retained as described above. In FIG. 8 there is shown a disc-like non-explosive spacer body 40 which is provided in lieu of an explosive charge. As shown in FIG. 8A, spacer body 40 simulates the engagement member provided by the nose of an explosive charge and spacer body 42 (not visible in FIG. 8), which may be similar or identical to spacer body 40, simulates the engagement member provided by the initiation end of the explosive charge. Spacer bodies 40 and 42 comprise discs having peripheral grooves, and which are inserted into the retainer cage in the place of the omitted explosive charges. For example, the groove of spacer body 40 would be sized identically to the groove 22*a* of extension flange 22 (FIG. 7), and the groove of spacer body 42 would be sized identically to the groove 24*a* of nose 24 (FIG. 7). In this manner, the loops 15 of the retainer cage are filled in the same manner as they would be if an explosive charge were utilized in place of spacer bodies 40, 42. This facilitates fabrication of the retainer cage and the rigidity and structural integrity thereof.

While the invention has been described in detail with respect to specific embodiments thereof, it will be appreciated that the scope of the invention is broader than the illustrated embodiments and is defined by the appended claims.

What is claimed is:

1. A perforating gun for retaining a plurality of explosive charges in an angularly phased linear array comprises:

a plurality of support wires extending in an undulating path about a common longitudinal axis to define a longitudinally extending retainer cage; and a plurality of explosive charges having respective discharge ends and initiation ends, the initiation ends being dimensioned and configured to receive a detonation signal transmission member, and the explosive charges being retained in a linear array within the retainer cage with the discharge ends thereof disposed along the undulating path and facing outwardly of the retainer cage, whereby the discharge end of each succeeding explosive charge is at a selected angular orientation relative to the other explosive charges, which angular orientation is determined by the configuration of the undulating path.

2. The perforating gun of claim 1 wherein the support wires are helically twisted whereby to define the undulating path as a helical path.

3. The perforating gun of claim 1 or claim 2 wherein at least two of the support wires are arranged in a wire pair in which the support wires thereof are connected to each other by a series of connector ties disposed at intervals along the length of the wire pair.

4. The perforating gun of claim 1 or claim 2 wherein pairs of the support wires are arranged in one or more wire pairs in which the support wires of a wire pair are in side-by-side alignment with each other in a series of longitudinal segments of the wire pair, and the longitudinal segments are longitudinally spaced from each other by a series of loops formed by the respective support wires of the wire pair diverging from each other and then re-converging towards each other to define the loops.

5. The perforating gun of claim 4 wherein the wire pairs are in abutting contact with each other in the series of longitudinal segments.

6. The perforating gun of claim 1 or claim 2 having a first connector at one end of the retainer cage and a second connector at the longitudinally opposite end of the retainer cage, the first and second connectors being dimensioned and configured to connect the retainer cage to one or both of (a) additional retainer cages and (b) other fixtures.

7. The perforating gun of claim 1 or claim 2 comprising at least one wire pair defined by two of the support wires cooperating with each other to define the wire pair.

8. The perforating gun of claim 7 wherein the explosive charges have respective engagement members on at least one of their discharge and initiation ends, and the engagement members are retained between the support wires of the wire pair.

9. The perforating gun of claim 7 wherein the support wires of the wire pair are connected to each other by connector ties at intervals along the length thereof.

10. The perforating gun of claim 8 wherein the explosive charges have respective engagement members on their discharge ends and the engagement members are retained between the support wires of the wire pair.

11. The perforating gun of claim 8 wherein the explosive charges have respective engagement members on their initiation ends and the engagement members are retained between the support wires of the wire pair.

12. The perforating gun of claim 8 wherein the explosive charges have respective engagement members on their discharge ends and respective engagement members on their initiation ends and the engagement members on the discharge ends are retained between the support wires of a first wire pair and the engagement members on the initiation ends are retained between the support wires of a second wire pair.

13. The perforating gun of claim 1 or claim 2 wherein the retainer cage comprises at least a first support wire engaged with respective discharge ends of the explosive charges and at least a second support wire engaged with the respective initiation ends of the explosive charges, and a plurality of crosspieces connecting the first and second support wires to reinforce the retainer cage.

14. The perforating gun of claim 1 or claim 2 wherein the retainer cage comprises a first pair of the support wires cooperating to provide a first wire pair engaging the discharge ends of the explosive charges and a second pair of the support wires cooperating to provide a second wire pair engaging the initiation ends of the explosive charges.

15. The perforating gun of claim 14 further comprising a plurality of crosspieces connecting at least one support wire of the first wire pair to at least one support wire of the second wire pair to reinforce the retainer cage.

16. The perforating gun of claim 1 or claim 2 wherein one or more of the explosive charges are replaced by non-explosive spacer bodies.

17. The perforating gun of claim 16 wherein a plurality of the explosive charges are replaced by non-explosive spacer bodies.

18. The perforating gun of claim 1 or claim 2 wherein the explosive charges have respective engagement members thereon, the engagement members being dimensioned and configured to be engaged by the support wires of the retainer cage and one or more of the explosive charges are replaced by non-explosive spacer bodies having thereon spacer engagement members which simulate the dimensions of the engagement members of the explosive charges.

19. The perforating gun of claim 18 wherein the spacer members comprise discs and the spacer engagement members comprise peripheral grooves in the disc.

* * * * *